US005429389A

United States Patent [19]

Shandell

[11] Patent Number: 5,429,389

[45] Date of Patent: Jul. 4, 1995

[54] SKI POLE HANDGRIP

[76] Inventor: Kenneth E. Shandell, 2225 Camino Del Rio South, #B, San Diego, Calif. 92108

[21] Appl. No.: 153,023

[22] Filed: Nov. 15, 1993

[51] Int. Cl.[6] ..... A63C 11/22

[52] U.S. Cl. ..... 280/821

[58] Field of Search ..... 280/821, 819, 809; 135/66; 116/DIG. 11

[56] References Cited

U.S. PATENT DOCUMENTS

| | | | |
|---|---|---|---|
| 4,073,817 | 5/1977 | Lah et al. | 280/821 |
| 4,082,302 | 4/1978 | Albrecht | 280/821 |
| 4,832,368 | 5/1989 | Steffanoff | 280/821 |
| 4,930,810 | 6/1990 | Addison, Jr. | 280/821 |
| 4,967,684 | 11/1990 | Vidovic et al. | 280/821 |

OTHER PUBLICATIONS

Herrington—The Enthusiasts' Catalog, Fall 1993, p. 75.

*Primary Examiner*—Richard M. Camby
*Attorney, Agent, or Firm*—Brown, Martin, Haller & McClain

[57] ABSTRACT

A ski pole handgrip has an inner, sound chamber in which a sound generating unit is mounted. The unit is powered by a conventional, replaceable battery and has an actuator button which projects out of the chamber through an opening in the outer surface of the handgrip for operation by a person grasping the handgrip when they want the unit to emit a warning sound.

10 Claims, 1 Drawing Sheet

SKI POLE HANDGRIP

BACKGROUND OF THE INVENTION

The present invention relates generally to ski pole handles or handgrips.

Ski poles generally have rubber or plastic handgrips for gripping by the skier while descending a slope. The handgrips are typically cylindrical members with a bore for fitting telescopically over the upper end of a metal ski pole, and with an outer surface shaped for convenient and comfortable gripping by the skier. Such grips are made in a so-called "sabre" type having an integral, arcuate portion for surrounding the user's hand when gripping the handgrip member. Another type has a straight, cylindrical body and a strap secured to the upper end of the handgrip, and the user inserts their hand through the strap before grasping the handgrip. This helps to prevent accidental loss of the pole.

One problem when skiing downhill or cross-country is that it is difficult to warn skiers in front of a rearward skier's approach and intent to overtake.

SUMMARY OF THE INVENTION

It is an object of the present invention to provide a new and improved handgrip for a ski pole with an built-in warning device for warning others of a skier's approach and aiding in location of a lost or disabled skier.

According to the present invention, a handgrip for a ski pole is provided, which comprises a generally cylindrical handgrip member having an upper end and a lower end, a bore extending upwardly from the lower end of the handgrip member for fitting over the upper end of a ski pole, the handgrip member having a recess or sound chamber, a sound generating unit for emitting an audible warning signal mounted in the chamber, the sound generating unit having an actuator button projecting outwardly from the chamber for controlling actuation of the unit, the actuator button being movable between a first, outermost position in which the unit is off, and a second, depressed position in which the unit is actuated to emit an audible warning signal.

Preferably, the recess or chamber is located at a position on the handgrip member which is not normally covered by a person's hand grasping the handgrip member, but which is easily accessible by the user's thumb, for example, to depress the actuator button when a warning signal is needed. In a preferred embodiment of the invention, the chamber is located adjacent the upper end of the handgrip member. The actuator button preferably projects above the upper surface of the actuator member at least in the first, off position so that it can be depressed readily by a user who will typically be wearing relatively thick and bulky ski gloves. The user only needs to depress the button a short distance, to a location at or close to the surface of the handgrip member, in order to actuate the noise making device.

The sound generating unit is built into the handgrip itself, making it less likely to be accidentally detached or lost, and making it less obtrusive and easier to use than would be a separate buzzer, bell or the like. Any suitable sound generating device may be used, such as an electric bell or buzzer, or an electro-acoustic transducer. The device is connected to a power supply such as a conventional battery via a switch which is operated by the actuator button. The actuator button is biassed into the off position so that the sound will only be emitted while the user is actually depressing the button.

With this arrangement, the skier can easily warn others in front of his or her approach, simply by quickly depressing the actuator button with a thumb pressure. Collisions between faster and slower skiers will thereby be less likely to occur.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 1:
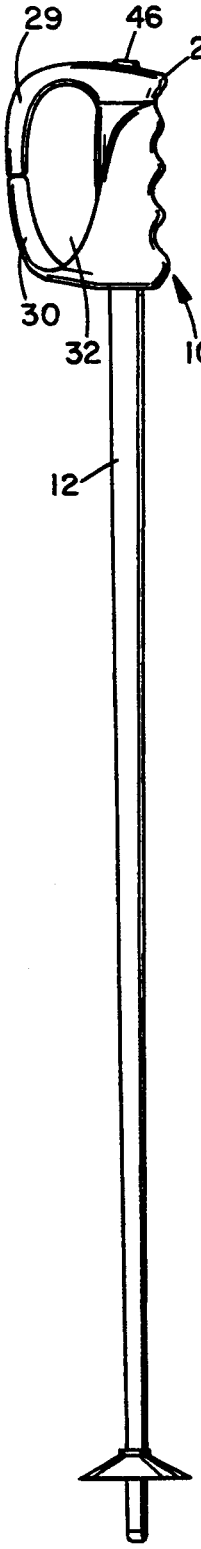
FIG. 1 is a view from the rear of a typical ski pole incorporating a handgrip with built-in sound generator according to one embodiment of the invention.
Figure 2:
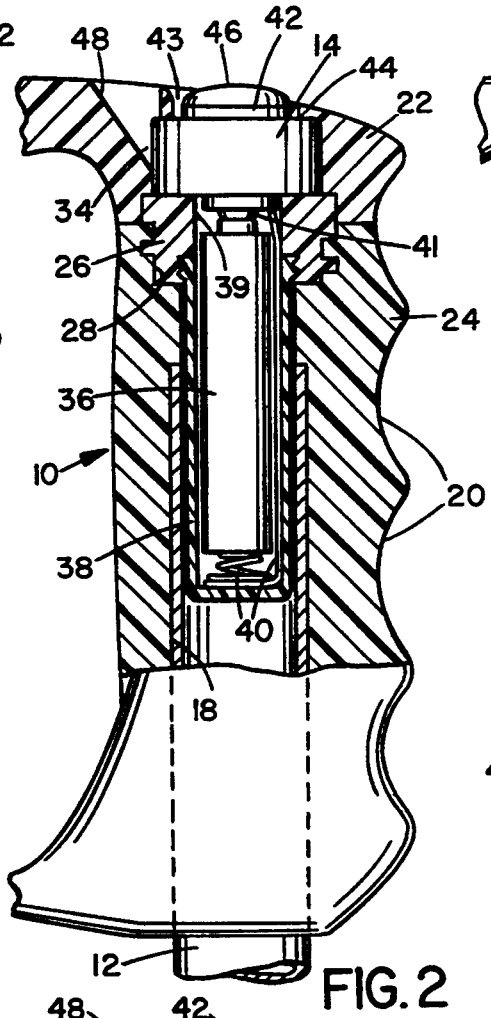
FIG. 2 is an enlarged side elevation view of the handgrip, with portions cut away.
Figure 3:
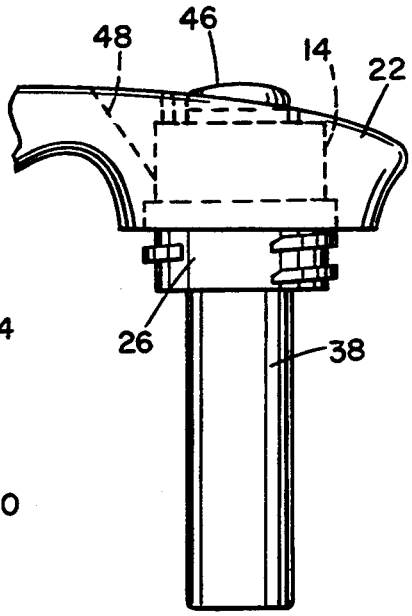
FIG. 3 is a side elevation view of the cap and battery holder assembly.
Figure 4:
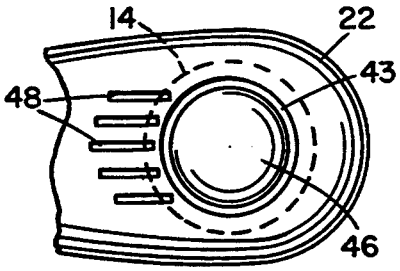
FIG. 4 is a top plan view of the cap.

FIG. 1 of the drawings illustrates a handgrip 10 according to a first embodiment of the invention installed on the upper end of a conventional ski pole 12, while FIGS. 2–4 illustrate the handgrip 10 in more detail. The handgrip 10 is of a conventional, so-called "sabre" shape, and has a built-in sound generating device or buzzer unit 14. The handgrip is preferably made of hard plastic material or rubber.

Handgrip 10 has a generally cylindrical body with a bore 18 extending upwardly from the lower end of the body for fitting telescopically over the upper end of ski pole 12. The outer surface of the handgrip 10 has conventional gripping formations 20 on one side for providing a better purchase for the fingers of a person grasping the body 16. The handgrip 10 is made in two separate parts, comprising upper part or cap 22 and lower part 24, which are releasably secured together via a threaded boss 26 projecting from the lower end of upper part 22 and a correspondingly threaded bore portion 28 at the upper end of lower part 24. Preferably, the threads on boss 26 and bore portion 28 are quarter turn threads. Boss 26 is secured to cap 22 by any suitable means, such as adhesive bonding, or may be formed as an integral lower wall of cap 22. Each of the parts 22,24 has an arcuate or hook-like extension 29,30 from the upper and lower end of handgrip body, respectively, which meet to form an opening 32 through which the user's hand extends when gripping the grip 10, for added security. Typically, users will grasp the handgrip 10 with the extensions 29 and 30 facing forwardly while skiing.

The sound generating unit 14 is a conventional sound generating device or buzzer such as an audio transducer mounted in a recess or chamber 34 in the upper part or cap 22. A conventional cylindrical flashlight battery 36 for powering the transducer is mounted in a cylindrical battery holder 38 releasably secured to the lower end of cap 22. Battery holder 38 has an open upper end communicating with through bore 39 in the boss 26 or lower wall of cap 22. Flashlight-type battery connections 40 are provided in the lower end of battery holder 38. The battery 36 projects upwardly into bore 39 and engages contact 41 on the lower end of sound generating unit 14. An actuator button 42 projects upwardly from device 34 through an opening 43 provided for that purpose in the upper wall 44 of cap 22. Actuator button 42 controls connection of the battery to the device 14 in a conventional manner, and is suitably biassed into the off position illustrated in FIGS. 2 and 3 in which the upper end 46 of button 42 projects above the upper surface of cap 22.

A series of spaced, parallel sound emitting slots 48 are provided in the upper wall 44 of the cap 22 communicating with chamber 34, at a location adjacent the forward end of the handgrip for better transmission of sounds from unit 14 when the button 42 is depressed. It will be understood that the slots 48 may alternatively be provided in a forwardly facing portion of the annular side wall of cap 22.

As best illustrated in FIG. 2, the battery holder 38 is releasably secured in a threaded portion at the lower end of bore 39 via a corresponding threaded portion provided at the upper end of holder 38. Any alternative type of releasable connection may be provided between battery holder 38 and boss 26, such as a slide-on, snap engagement between the parts. The battery holder 38 projects downwardly into the upper end of bore 18 and tubular ski pole 12 when the lower part 24 of the handle is secured to boss 26.

Figure 5:
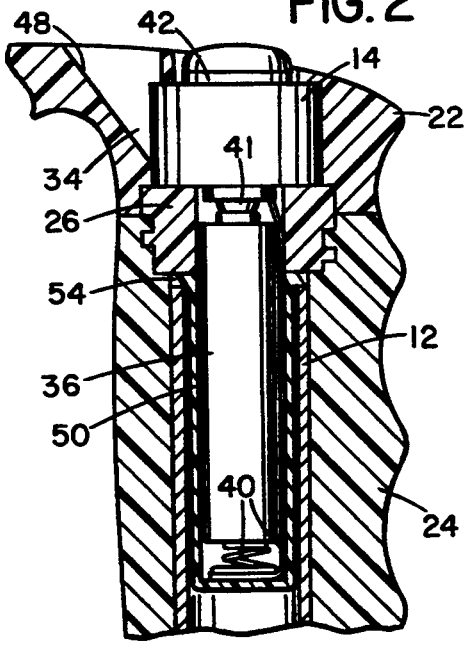
FIG. 5 is a view similar to FIG. 2, showing a modification in which the battery holder is separate from the cap.

FIG. 5 illustrates an alternative arrangement in which a battery holder 50 is instead mounted in the lower part 24 of the grip and has an annular rim 54 which seats on the upper end of ski pole 12. In this arrangement, the battery 36 will first be inserted into holder 50 before securing the cap 22 to the lower part 24 of the handgrip. However, this version is otherwise identical to that of FIGS. 1–4 and like reference numerals have been used for like parts as appropriate.

When using the handgrip of FIGS. 1–4 or FIG. 5 while skiing, the skier can easily warn other, slower skiers in front of their approach by pressing down on push-button 42. Because the button protrudes upwardly above the surface of the cap, it will be easy to actuate even when a wearer is wearing thick ski gloves, as will typically be the case. The actuator button is located at a position on the handgrip which is not normally grasped by the skier's hand, but which can be easily reached by a small movement of the thumb as needed. Thus, accidental actuation of the buzzer is avoided. Unit 14 will emit a relatively loud tone or "beep" when the button 42 is pressed down. A code may be established to indicate to skiers in front when a faster skier is passing to the left or right, for example one beep for right and two beeps for left, significantly reducing the risk of accidental collisions.

Another advantage of the handgrip with built-in sound generating unit is that it may help in locating skiers in the event of an avalanche or other accident. An immobilized skier, if they retain their grasp on the handle, can press the button 42 to produce an audible signal in order to help rescue workers in finding them.

The sound generating unit may be of the type having variable output tone, with a softer tone when the button is depressed lightly and a louder tone when it is depressed firmly. The battery can be changed easily when necessary simply by separating the two parts of the handgrip, and removing the battery casing 38 from boss 26 together with the used battery, which can then be replaced with a new battery. The parts are then reassembled. Similarly, in the version of FIG. 5, the parts 22 and 24 are separated and the old battery can then simply be lifted out of the casing in lower part 24 and replaced.

Figure 6:
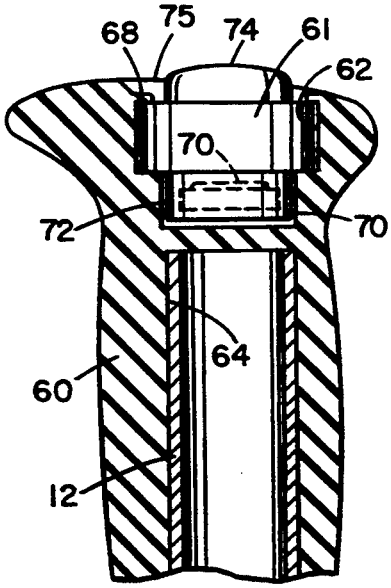
FIG. 6 is a further similar view showing a compact sound generator unit in a unitary handgrip and cap.

FIG. 6 illustrates an alternative embodiment of the invention in which the handgrip 60 is made in one piece rather than two separate parts as in the previous embodiment, and the sound generating unit 61 is more compact. Handgrip 60 is of the straight type rather than the sabre type as in the previous embodiments, and will typically have a security strap loop (not illustrated) secured at its upper end through which the user inserts their hand before grasping the grip 60. Grip 60 has a recess or chamber 62 at its upper end, and a bore 64 extending upwardly from its lower end which fits over the upper end of ski pole 12. Sound generating unit 61, which is equivalent to unit 14 of the previous embodiments, is mounted in recess 62 and releasably retained in the recess via an annular, resilient retaining flange 68 which projects inwardly over the edge of unit 61 at the upper end of the chamber.

A button cell battery 70 is mounted in releasable battery casing 72 releasably secured to the lower end of unit 61 for powering the unit. A push-button actuator 74 projects upwardly from unit 66 through the open upper end of the handgrip, so that the upper end of actuator 74 is above the upper surface 75 of the handgrip when in the illustrated off position. Thus, as in the previous embodiment, the sound generating unit can be actuated to emit a tone or buzz simply by depressing actuator 74 a small distance with the thumb.

The battery 70 can be replaced quickly and easily when necessary simply by pushing retaining flange 68 to one side and popping out the unit 61 together with the battery casing 72 with a blade or the like. The old battery is then removed from casing 72 and replaced, and the entire unit is pushed back into position in recess 62. The unit 61 is more compact since it uses a much smaller battery.

The handgrips described above can be easily installed on ski poles, and provide a built-in sound generating unit for readily warning others in front of a faster skier's approach. The built-in sound generating unit also allows a lost, buried or injured skier to provide an audible, emergency locating signal to rescue personnel. They may be used to replace existing handgrips on any ski poles.

Although some preferred embodiments of the invention have been described above by way of example only, it will be understood by those skilled in the field that modifications may be made to the disclosed embodiments without departing from the scope of the invention, which is defined by the appended claims.

I claim:

1. A handgrip for a ski pole, comprising:

a handgrip body having an outer surface, an upper end and a lower end;

the body having a bore extending upwardly from the lower end for fitting over the upper end of a ski pole, and a sound chamber;

a sound generating unit mounted in said chamber for emitting a sound when actuated;

the body having an opening communicating with said chamber;

an actuator button projecting through said opening for controlling actuation of said sound generating unit, the button being movable between a first inoperative position in which the sound generating unit is off and a second, depressed position in which the sound generating unit is actuated;

the body being made in two parts, comprising a lower part and an upper cap part, the sound generating unit being mounted in the cap part and the upper and lower parts having interengageable formations for releasably securing the lower part to the upper part;

a battery holder releasably secured to the cap part for holding a battery for powering said sound generating unit; and the cap part having a lower wall having a through bore communicating with said sound chamber, and the batter holder being releasably secured to said lower wall, a battery in said holder projecting upwardly through said bore into contact with said sound generating unit.

2. The grip as claimed in claim 1, wherein the sound chamber is provided adjacent the upper end of the cap part.

3. The grip as claimed in claim 2, wherein the cap part has an upper wall covering said chamber, and said opening is provided in said upper wall.

4. The grip as claimed in claim 3, wherein the actuator button projects above the upper wall of said cap part at least in said inoperative position.

5. The grip as claimed in claim 1, wherein the cap part has a wall covering said chamber, and said opening is provided in said wall.

6. The grip as claimed in claim 5, wherein sound slots are provided in said wall for transmitting sounds out of said chamber.

7. A handgrip for a ski pole, comprising:

a handgrip body having an outer surface, an upper end and a lower end;

the body having a bore extending upwardly from the lower end for fitting over the upper end of a ski pole, and a sound chamber;

a sound generating unit mounted in said chamber for emitting a sound when actuated;

the body having an opening communicating with said chamber;

an actuator button projecting through said opening for controlling actuation of said sound generating unit, the button being movable between a first, inoperative position in which the sound generating unit is off and a second, depressed position in which the sound generating unit is actuated;

the body being made in two parts comprising a lower part and an upper cap part, the sound generating unit being mounted in the cap part and the upper and lower parts having interengageable formations for releasably securing the lower part to the upper part; and the cap part having an upper end and a lower end, each having an opening communicating with said chamber, said actuator button projecting through said upper end opening, and a battery holder connected to the lower end of the cap part, the battery holder having an upper, open end aligned with said lower end opening, and a battery in said holder projecting upwardly into said lower end opening for connection to said sound generating unit.

8. A ski pole, comprising:

a tubular rigid ski pole member having a lower end and an upper end;

a handgrip member secured over the upper end of the ski pole member for gripping by a user, the handgrip member having an outer surface shaped to form a hand gripping surface over part of its area;

the handgrip member having an internal sound chamber and at least one opening extending from said outer surface into said chamber;

a sound generating unit mounted in said sound chamber for emitting sounds when actuated;

an actuator button for actuating said sound generating unit extending from said sound generating unit through said opening, the button being movable between an outer, inoperative position in which said sound generating unit is off and an inner, depressed position in which said sound generating unit is actuated;

the handgrip member being made in two parts, comprising a lower part having a through bore in which the upper end of said ski pole member is secured and an upper cap part in which said sound chamber is located, the upper and lower parts having interengageable formations for releasably securing the upper part to the lower part;

a battery holder mounted in the upper end of said lower part, said cap part having a lower wall extending across said chamber, and said lower wall having an opening communicating with said battery holder when said parts are secured together; and a battery in said holder projecting upwardly into said lower wall opening for connection to said sound generating unit.

9. The pole as claimed in claim 8, wherein the opening is provided in a part of said outer surface which is not normally gripped by a user holding the pole.

10. The pole as claimed in claim 8, wherein said button projects outwardly from said outer surface at least in said inoperative position.

* * * * *